US009114953B2

(12) United States Patent
Mason

(10) Patent No.: US 9,114,953 B2
(45) Date of Patent: Aug. 25, 2015

(54) EMERGENCY OPERATION OF ELEVATORS BASED ON AN INDICATED EMERGENCY CONDITION

(75) Inventor: Christopher Mason, Ledgewood, NJ (US)

(73) Assignee: Inventio AG, Hergiswil NW (CH)

( * ) Notice: Subject to any disclaimer, the term of this patent is extended or adjusted under 35 U.S.C. 154(b) by 834 days.

(21) Appl. No.: 13/340,374

(22) Filed: Dec. 29, 2011

(65) Prior Publication Data

US 2013/0168191 A1 Jul. 4, 2013

(51) Int. Cl.
*B66B 1/34* (2006.01)
*B66B 5/00* (2006.01)

(52) U.S. Cl.
CPC ..... *B66B 5/0012* (2013.01)

(58) Field of Classification Search
CPC ..... B66B 5/02; B66B 5/0012
USPC ..... 187/247, 248, 313, 316, 380–388, 187/391–396
See application file for complete search history.

(56) References Cited

U.S. PATENT DOCUMENTS

| | | | | |
|---|---|---|---|---|
| 4,690,251 | A | 9/1987 | Onoda et al. | |
| 4,839,631 | A * | 6/1989 | Tsuji | 340/541 |
| 5,131,508 | A * | 7/1992 | Suzuki | 187/380 |
| 5,979,607 | A * | 11/1999 | Allen | 187/390 |
| 6,062,346 | A | 5/2000 | Friedli et al. | |
| 6,707,374 | B1 * | 3/2004 | Zaharia | 340/5.31 |
| 6,801,792 | B1 | 10/2004 | Schuster et al. | |
| 7,182,174 | B2 * | 2/2007 | Parrini et al. | 182/18 |
| 7,267,203 | B2 | 9/2007 | Sekimoto | |
| 7,284,639 | B2 * | 10/2007 | Sasaki et al. | 187/395 |
| 7,588,126 | B2 * | 9/2009 | Siikonen et al. | 187/384 |
| 7,823,703 | B2 * | 11/2010 | Amano | 187/392 |
| 7,954,603 | B2 * | 6/2011 | Hikita et al. | 187/284 |
| 8,281,901 | B2 * | 10/2012 | Kawai et al. | 187/392 |
| 8,365,871 | B2 * | 2/2013 | Lee et al. | 187/392 |
| 8,464,840 | B2 * | 6/2013 | Flynn et al. | 187/384 |
| 8,763,761 | B2 * | 7/2014 | Siikonen | 187/384 |
| 2004/0055828 | A1 | 3/2004 | Kavounas | |
| 2008/0016962 | A1 | 1/2008 | Dwyer et al. | |
| 2009/0127030 | A1 | 5/2009 | Hikita et al. | |

FOREIGN PATENT DOCUMENTS

| | | | |
|---|---|---|---|
| GB | 2267977 | A | 12/1993 |
| JP | 2005082292 | A | 3/2005 |
| JP | 2008-100804 | A | 5/2008 |
| JP | 2008100804 | A | 5/2008 |

(Continued)

OTHER PUBLICATIONS

International Search Report and the Written Opinion dated Apr. 16, 2013 issued in corresponding International Application No. PCT/EP2012/074970.

(Continued)

*Primary Examiner* — Anthony Salata
(74) *Attorney, Agent, or Firm* — Stroock & Stroock & Lavan LLP

(57) ABSTRACT

An elevator system directs an elevator car to one or more particular floors based on a type of emergency that appears to be occurring in the car. The emergency is detected using one or more sensor units in or on the elevator car. The elevator system can direct the car to a floor that has equipment and/or personnel for handling the emergency.

19 Claims, 5 Drawing Sheets

(56) References Cited

FOREIGN PATENT DOCUMENTS

| | | | |
|---|---|---|---|
| JP | 2008-230805 | A | 10/2008 |
| WO | WO 2010/002378 | A1 | 1/2010 |

OTHER PUBLICATIONS

Zephyr Technology Corporation: "Leaders in Personal Performance and Condition Monitoring", www.zephyr-technology.com/bioharness-bt, Jun. 12, 2011, pp. 1-5.

* cited by examiner

EMERGENCY OPERATION OF ELEVATORS BASED ON AN INDICATED EMERGENCY CONDITION

FIELD

This disclosure relates to the operation of an elevator system in an emergency situation.

BACKGROUND

Generally, during an emergency it is important to bring emergency victims and emergency assistance together. In some cases, this can be done using elevator systems.

SUMMARY

In at least some embodiments of the disclosed technologies, an elevator system directs an elevator car to one or more particular floors based on a type of emergency that appears to be occurring in the car. The elevator system can direct the car to a floor that has equipment and/or personnel for handling the emergency.

In some embodiments, an elevator operation method comprises: receiving, using a computer, an indication of an emergency situation for a passenger in an elevator car; based on the indication and using the computer, selecting an emergency type for the emergency situation out of a plurality of possible emergency types; and moving the elevator car to a building floor associated with the selected emergency type. The indication of the emergency situation can be received from a sensor unit borne by the passenger. The sensor unit can store patient data for the passenger. The indication of the emergency situation can also be received from a sensor unit attached to the elevator car. The indication of the emergency situation can also be received from a button in the elevator car. The plurality of possible emergency types can comprise a first emergency type and a second emergency type, the first emergency type being associated with a first floor and the second emergency type being associated with a second floor, the first floor being different from the second floor. The method can further comprise contacting an alarm-monitoring system based on the indication of the emergency situation. The method can further comprise holding one or more doors of the elevator car at least partially open after the elevator car reaches the floor associated with the selected emergency type. In some cases, the floor associated with the selected emergency type has one or more emergency devices for the selected emergency type. In further cases, the floor associated with the selected emergency type has one or more persons for handling the selected emergency type. The selected emergency type can be a lost-passenger emergency type. In particular embodiments, the method further comprises notifying medical personnel of arrival of the elevator car at the building floor associated with the selected emergency type.

Embodiments of an elevator installation can comprise, for example: an elevator car disposed in an elevator shaft; and a computer-based elevator control unit, the elevator control unit being configured to, receive an indication of an emergency situation for a passenger in the elevator car, based on the indication, select an emergency type for the emergency situation out of a plurality of possible emergency types, and move the elevator car to a building floor associated with the selected emergency type. The plurality of possible emergency types can comprise a first medical emergency type and a second medical emergency type, the first medical emergency type being associated with a first building floor and the second medical emergency type being associated with a second building floor, the first building floor being different from the second building floor. The plurality of possible emergency types can comprise a medical emergency type and a crime emergency type.

In additional embodiments, a method comprises: receiving biometric data for a person; determining, based on the biometric data, that the person is in an emergency situation; and sending an indication of the emergency situation to an elevator installation. In some cases, the person is inside an elevator car of the elevator installation when the indication of the emergency situation is sent. In other cases, the person is outside of an elevator car of the elevator installation when the indication of the emergency situation is sent.

Exemplary embodiments of an elevator control unit comprise: a processor; and one or more computer-readable storage media having encoded thereon instructions that, when executed by the processor, cause the processor to perform a method, the method comprising, receiving an indication of an emergency situation for a passenger in an elevator car, based on the indication, selecting an emergency type for the emergency situation out of a plurality of possible emergency types, and moving the elevator car to a building floor associated with the selected emergency type.

In further embodiments, one or more method acts disclosed herein are performed by a processor executing instructions stored on one or more computer-readable storage media.

BRIEF DESCRIPTION OF THE DRAWINGS

The disclosure refers to the following figures, in which.

DETAILED DESCRIPTION

Figure 1:
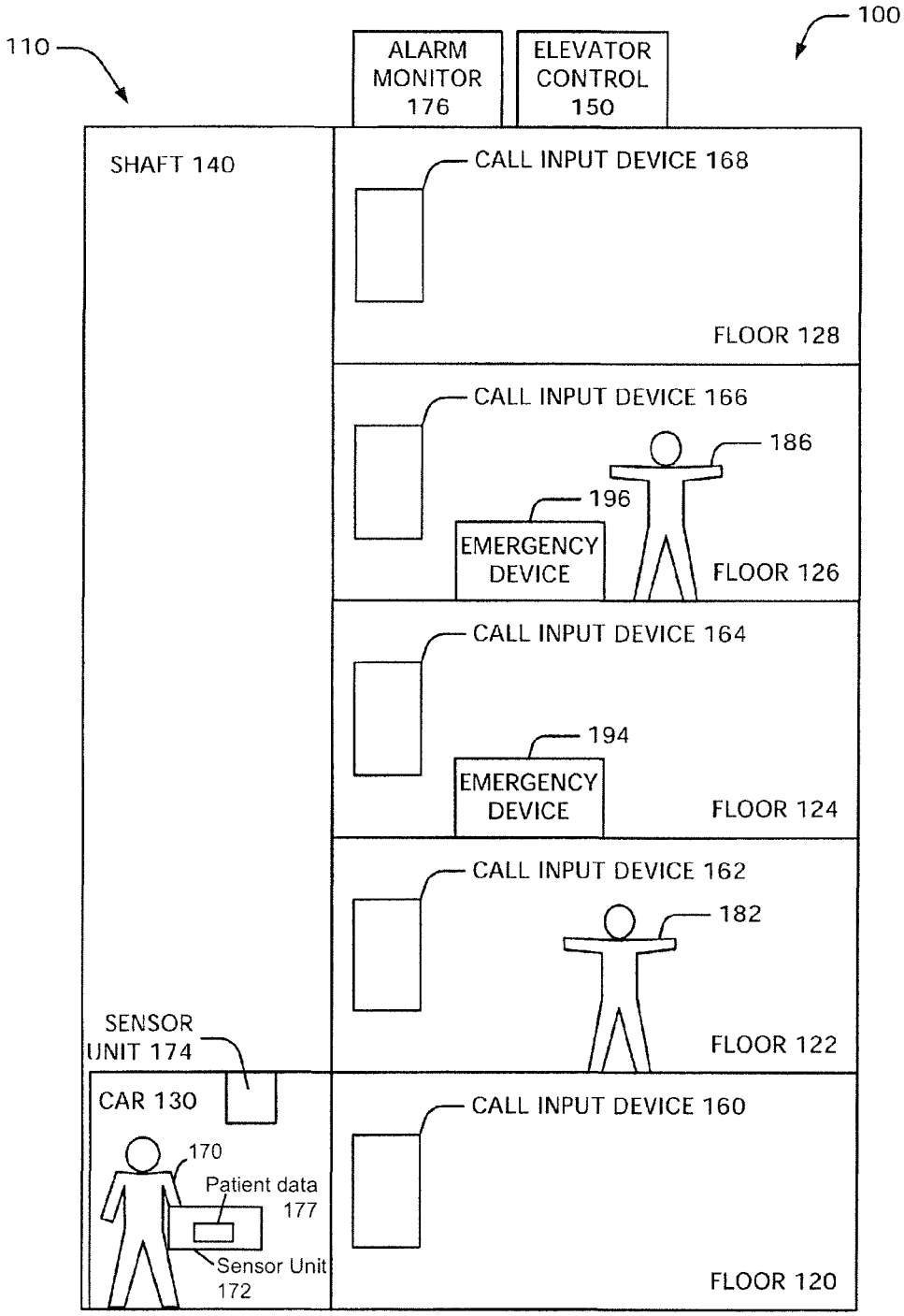
FIG. 1 is a block diagram of an exemplary embodiment of a building having an elevator installation.

Disclosed below are embodiments of elevator control and building control technologies and/or related systems and methods. The embodiments should not be construed as limiting in any way. Instead, the present disclosure is directed toward all novel and nonobvious features and aspects of the various disclosed methods and systems, and equivalents thereof, alone and in various combinations and sub-combinations with one another. The methods disclosed herein are not performed purely in the human mind.

As used in this application and in the claims, the singular forms "a," "an" and "the" include the plural forms unless the context clearly dictates otherwise. Additionally, the term "includes" means "comprises." When used in a sentence, the phrase "and/or" can mean "one or more of" the elements described in the sentence. Embodiments described herein are exemplary embodiments of the disclosed technologies unless clearly stated otherwise.

Although the operations of some of the disclosed methods and systems are described in a particular, sequential order for convenient presentation, it should be understood that this manner of description encompasses rearrangement, unless a particular ordering is required by specific language set forth herein. For example, operations described sequentially can in some cases be rearranged or performed concurrently.

For the sake of simplicity, the figures may not show all of the various ways in which the disclosed methods and systems can be used in conjunction with other methods and systems. Additionally, the description sometimes uses terms like "receive," "associate" and "send" to describe the disclosed technologies. These and other terms are high-level abstractions of the actual operations that are performed. The actual operations that correspond to these terms may vary depending on the particular implementation and are readily discernible by one of ordinary skill in the art.

Any of the methods described herein can be performed using software comprising computer-executable instructions stored on one or more computer-readable storage media. Furthermore, any intermediate or final results of the disclosed methods can be stored on one or more computer-readable storage media. Computer-readable storage media can include non-volatile storage such as, for example, read-only memory (ROM), flash memory, hard disk drives, floppy disks and optical disks. Computer-readable storage media can also include volatile storage such as, for example, random-access memory (RAM), device registers and processor registers. Any such software can be executed on a single computer or on a networked computer (networked, for example, via the Internet, a wide-area network, a local-area network, a client-server network, or other such network). Computer-readable storage media do not include embodiments that are pure transitory signals.

For clarity, only certain selected aspects of the software-based implementations are described. Other details that are well known in the art are omitted. For example, it should be understood that the disclosed technologies are not limited to any specific computer language, program, or computer. For instance, the disclosed embodiments can be implemented using a wide variety of commercially available computer systems. Any of the disclosed methods can alternatively be implemented (partially or completely) in hardware. Portions of one or more disclosed methods can be executed by different parts of a distributed computing environment.

Furthermore, any of the software embodiments (comprising, for example, computer-executable instructions for causing a computer to perform any of the disclosed methods) can be transmitted, received, or accessed through a suitable communication means. Similarly, intermediate or final method results, created or modified using any of the disclosed methods, can be transmitted, received, or accessed through a suitable communication means. Such suitable communication means include, for example, the Internet, an intranet, cable (including fiber optic cable), magnetic communication means, electromagnetic communication means (including RF, microwave, and infrared communications), electronic communication means, or other such communication means.

Various embodiments of one or more electronic devices can be used with at least some of the disclosed technologies, including a handheld computing device (e.g., a personal digital assistant (PDA), a cell phone, a smartphone, a portable music or video player) and a personal computer (e.g., a desktop computer, a laptop computer, a netbook, a server, a thin client). At least some electronic devices can be configured to receive data from and/or transmit data to a network (e.g., a wireless network, the Internet).

FIG. 1 shows a block diagram of an exemplary embodiment of a building 100 served by an elevator installation 110. The building 100 comprises a plurality of floors 120, 122, 124, 126, 128, which are served by the elevator installation 110. An elevator car 130 moves within a shaft 140 to reach the various floors 120, 122, 124, 126, 128. The car 130 can be moved using various components, which (to improve clarity) are not shown in FIG. 1. Operation of the elevator installation 110 is controlled by a control unit 150. The control unit 150 is computer-based and comprises, for example, at least one processor and at least one computer-readable storage medium that stores instructions for the processor. Although only one elevator car 130 and one elevator shaft 140 appear in FIG. 1, one or more embodiments of the disclosed technologies can be used with installations having multiple shafts and multiple cars, including installations with multiple cars in a given shaft.

In at least some embodiments, the control unit 150 receives destination call signals from one or more destination call input devices 160, 162, 164, 166, 168, which are arranged on one or more of the floors 120, 122, 124, 126, 128. Generally, destination call input technology allows a destination for a user 170 to be determined before the user 170 enters the car 130 (such technology is sometimes referred to as "destination call control"). In some cases, a data storage device (e.g., an RFID card; not shown) is used to transmit to the elevator installation 110 identifying information associated with the passenger 170. Based on the identifying information, the control unit 150 determines a destination for the user 170. In further embodiments, the user 170 (identified or unidentified) can input a destination using a destination call input device 160, 162, 164, 166, 168. In embodiments where the installation 110 comprises multiple elevator cars in multiple respective shafts, the control unit 150 assigns the user 170 to a particular elevator car and communicates this assignment to the user 170. The control unit 150 directs the car 130 to carry the user 170 to the destination.

Various embodiments of the disclosed technologies can also be used with elevator systems that do not employ destination-call-control technologies. Such elevator systems can, for example, use elevator cars with interior button panels or other devices that allow a passenger to specify a destination after entering the car.

Although the user 170 is depicted in FIG. 1 as a person, in various embodiments the user 170 can also comprise multiple people, a machine, an animal and/or another object for transportation with the elevator installation 110.

Figure 2:
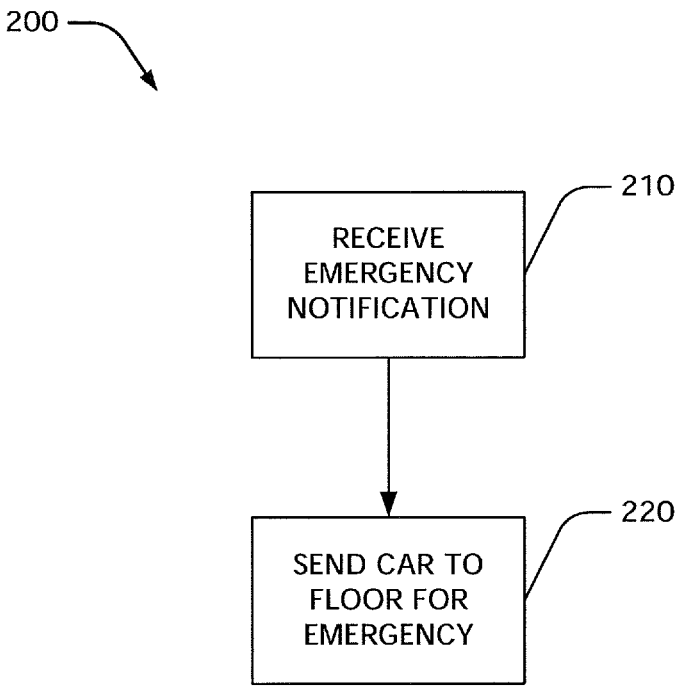
FIG. 2 is a block diagram of an exemplary embodiment of a method for operating an elevator during an emergency.

FIG. 2 shows a block diagram of an exemplary embodiment of a method 200 for operating an elevator during an emergency. The method 200 is described with respect to the installation 110 shown in FIG. 1, but the method 200 can also be used with other elevator installation embodiments, including other embodiments described herein. In a method act 210, the elevator installation 110 receives a notification of an emergency. In the context of this patent application and the claims, an "emergency" can include, for example, a medical emergency involving one or more persons and/or a safety emergency (e.g., a crime) involving one or more persons. In some embodiments, an "emergency" can also include a situation where a detected elevator user does not input elevator call information and/or does not respond to visual or audio stimuli.

The emergency notification can be generated by one or more sensor units that are in communication with the elevator installation 110. For example, returning to FIG. 1, a portable sensor unit 172 can be associated with one or more users 170 of the elevator. The portable sensor unit 172 can be carried or worn by the user 170. In some cases, the portable sensor unit 172 comprises a multi-function portable electronic device, such as a mobile telephone, smartphone, media player and/or portable computer. The sensor unit 172 can also be at least partially implanted in the user 170. In further embodiments, a sensor unit 174 is positioned in or on the car 130 (e.g., attached to an interior or exterior surface of the car 130). In some embodiments, the sensor unit 174 comprises a button on an interior surface of the car 130. The sensor units 172, 174 can be configured to detect one or more emergency conditions (e.g., a medical condition, or possible criminal activity). In some embodiments, the sensor units 172, 174 react to input from the user 170 (e.g., a button press, a voice input). In other embodiments, the sensor units 172, 174 do not require affirmative actions from the user 170. For example, in various embodiments the sensor units 172, 174 can: detect motion of the cabin 130 and/or occupants of the cabin 130; detect a number of occupants of the cabin 130; measure biometric data for passengers (e.g., heart rate, blood-oxygen reading, sugar/insulin level, perspiration and/or other vital signs); and/or request an audible response (e.g., a request for help) from passengers. In some cases the sensor units 172, 174 comprise one or more motion sensors and/or orientation sensors (e.g., accelerometers) and can detect a sudden fall of a passenger in the cabin 130 and/or a position of a passenger (e.g., sitting, laying, standing). In some embodiments, the sensor unit 172 is a component of a mobile telephone, smartphone or other electronic device that is running a monitoring application and is configured to wirelessly transmit information related to the passenger.

In some embodiments, the sensor unit 172,174 is configured to analyze data itself and determine whether the data indicate the presence of an emergency situation. In further embodiments, the sensor unit 172, 174 passes this data to another component in the elevator installation 110 (e.g., the elevator control 150) for determining whether an emergency situation likely exists and generating the emergency notification (if needed). In some cases, data from the sensor unit 172, 174 is passed to a human operator, who reviews the data, decides whether an emergency situation exists, and generates the emergency notification (if needed). The human operator can then contact emergency personnel. In additional embodiments, the human operator can communicate with the user 170 through the sensor unit 172, 174.

Data from the sensor units 172, 174 is communicated to the elevator installation 110 in a wired and/or wireless manner. For example, the sensor data can be received by the elevator control 150. In further embodiments, the sensor data is received by one or more other components.

In particular embodiments, the portable sensor unit 172 is a biometric sensor (BMS). The BMS comprises accelerometers, as well as sensors to measure user characteristics. The sensors can measure, for example, pulse, blood-oxygen mix, perspiration, body temperature and/or other quantities. The BMS can also store patient data 177 in a computer-readable memory. The data can include, for example, medical records for the user, known disorders of the user, risk factors of the user and/or other information. The BMS can be programmed to use measured and stored information to detect and/or diagnose an emergency incident. The BMS can instruct the elevator installation 110 to handle the emergency incident using one or more embodiments of methods disclosed herein. In some embodiments, the BMS can receive data from the elevator installation 110. For example, the BMS can receive data about whether a passenger has selected a destination floor or provided other input to the installation 110.

In further embodiments, the portable sensor unit 172 is similar to the BioHarness BT, available from Zephyr Technology Corporation. Other embodiments use other sensor models.

Returning to FIG. 2, in a method act 220, the car 130 is sent to a specific floor as a result of the emergency notification. For example, the elevator control 150 can move the car 130 to the floor 122, where one or more emergency persons 182 are available to aid the passenger user 170. In further embodiments, the elevator control 150 can move the car 130 to a floor 124, where one or more emergency devices 194 are available to aid the user 170. In additional embodiments, the elevator control 150 can move the car 130 to a floor 126, where both one or more emergency persons 186 and one or more emergency devices 196 are available for aiding the user 170. In particular embodiments, the car 130 is sent to the closest floor that has adequate medical equipment and/or personnel. In some cases, the car 130 is sent to a floor where a doctor of the user 170 is located.

Figure 3:
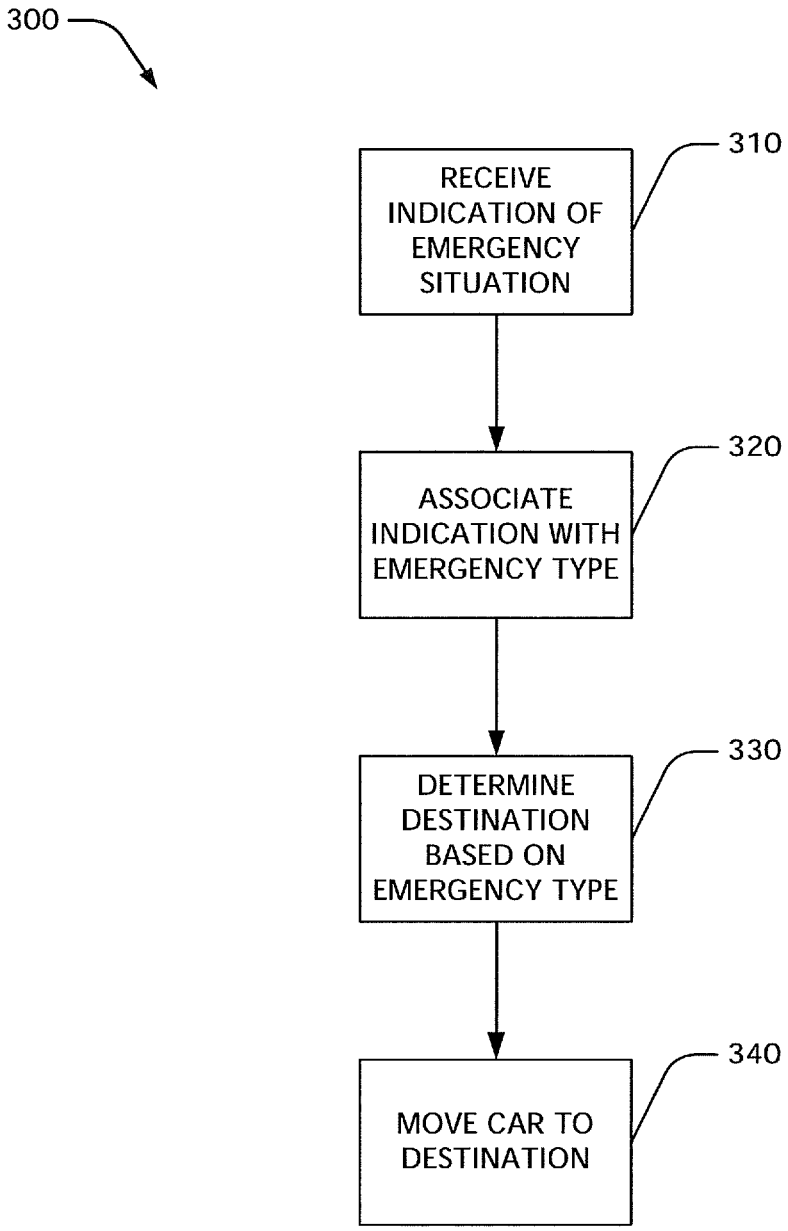
FIG. 3 is a block diagram of a further exemplary embodiment of a method for operating an elevator during an emergency.

FIG. 3 shows a block diagram of an exemplary embodiment of a method 300 for operating an elevator during an emergency. The method 300 is described with respect to the installation 110 shown in FIG. 1, but the method 300 can also be used with other elevator installation embodiments, including embodiments described herein.

In a method act 310, the installation 110 receives at least one indication of an emergency situation. The indication can comprise, for example, sensor data from one or more sensor units (e.g., sensor units 172, 174). In a method act 320, the installation 110 associates the indication of the emergency situation with one or more emergency types (e.g., heart attack, stroke, criminal assault, diabetic shock, coma, respiratory emergency (e.g., choking), asthma attack, fainting). In some embodiments, the installation 110 also determines the identity of the user 170. For example, the sensor unit 172 can be associated with the user 170.

Based on the association, a destination floor for the car 130 is determined in a method act 330. For example, the installation 110 can be configured to direct the car 130 to a first floor for a first type of emergency, or to a second floor for a second type of emergency. The destination floor can also be determined based at least in part on which floors the car 130 is currently closest to. Further considerations for determining the destination floor can include, for example, availability of medical personnel, whether a similar emergency is already in progress on a given floor, and/or where a doctor of the user 170 is located. It is possible, for example, that personnel and/or equipment for a given emergency type is available more readily or exclusively at one or more floors in the building 100. Table 1, below, shows non-limiting examples of emergency types, the floor(s) to which an elevator car can be sent based on the emergency type, emergency equipment and/or personnel available at the different floors.

TABLE 1

| Emergency Type | Floor | Equipment | Personnel |
|---|---|---|---|
| Heart attack | 1 | Defibrillator | Emergency medical technician (EMT) |
| Assault | 2, 4 | | Security officer, EMT |
| Asthma | 3 | Inhaler | |
| Fainting | 4 | | Security officer, EMT |
| Coma | 3 | | EMT |
| Choking | 1, 2, 4 | | EMT |
| Diabetic shock | 1, 3 | | EMT, medicine dispensary |

In a method act 340, the car 130 is moved to the determined destination floor. The user 170 can be visually and/or audibly informed of the actions of the car 130. In at least some embodiments, doors of the car 130 are held at least partially open at the destination floor. In some cases, one or more other travel requests for the system 110 are cancelled or delayed during the method 300. In further embodiments, emergency personnel can cause the car 130 to be moved to another floor.

It can be possible that simultaneous emergencies occur among multiple users in a car. In some embodiments, the elevator system 110 prioritizes the detected emergencies (e.g., the different emergency types) and moves the car 130 to a floor suitable for handling at least the emergency with the highest priority.

In further embodiments of the methods 200 or 300, the emergency situation results in the installation 110 activating an alarm monitor 176. The alarm monitor 176 can, for example, transmit information related to the emergency situation to a monitoring service (e.g., an emergency medical service, a security service, a building administration service). The transmitted information can include, for example, the location of the emergency and/or the nature of the emergency.

In at least some embodiments, one or more of the method acts described for the methods 200 or 300 can be performed by the elevator control 150.

Further embodiments can use the elevator installation 110 to help bring a lost or disoriented individual to a particular floor (e.g., a floor where the person's living quarters are located, or where the person can receive assistance). The system can identify an individual as lost or disoriented if, for example, the individual remains in the car without activating a call button or door button. This information can be sent to, for example, a BMS unit.

In additional embodiments, the elevator installation 110 can send an elevator car for a passenger who is determined to be in an emergency situation outside of the installation 110 (e.g., in a hallway or other portion of the building 100).

In still further embodiments, the elevator installation 110 can provide a user 170 with guidance (e.g., directions) in finding assistance for an emergency situation. For example, the installation 110 can direct the user 170, through a mobile telephone or other electronic device, from an elevator car to a location where medical assistance is available.

Figure 4:
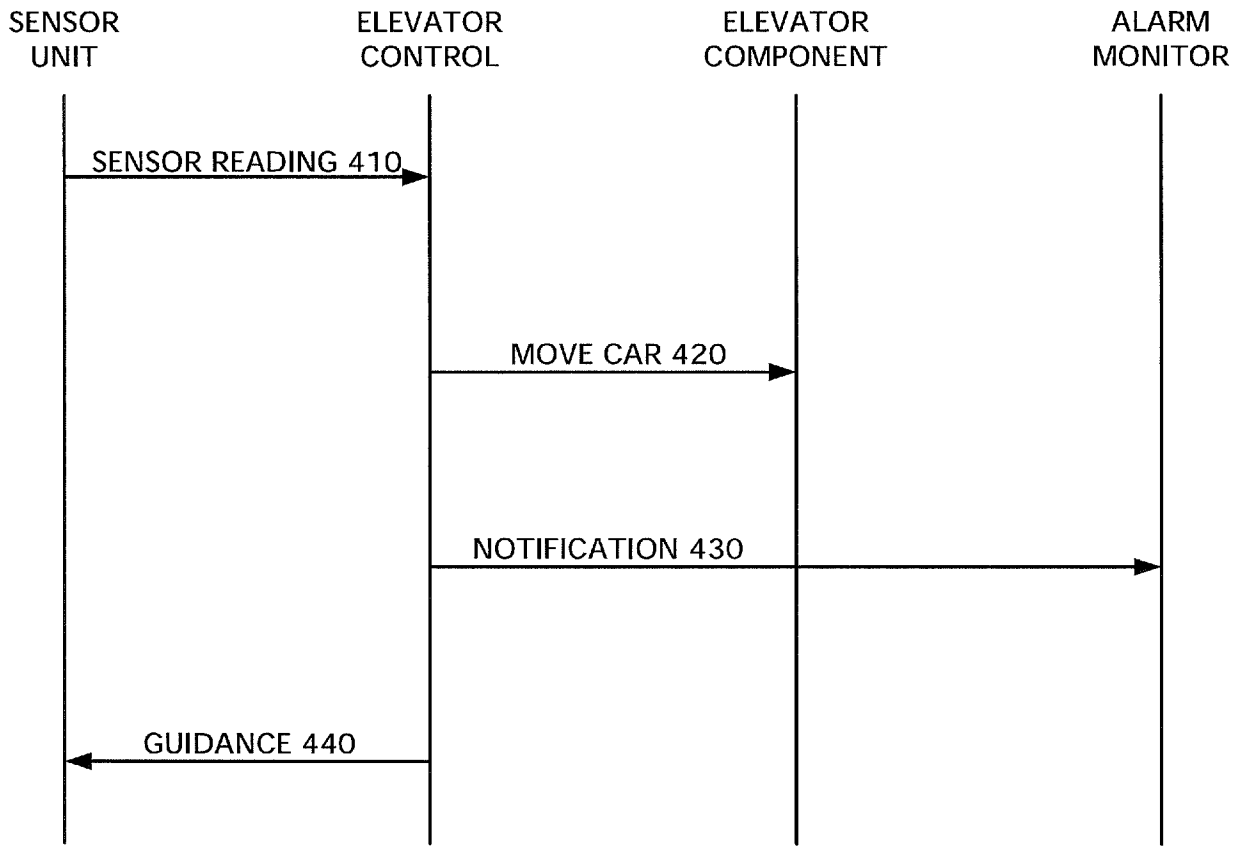
FIG. 4 is an exemplary embodiment of a signal diagram.

FIG. 4 shows an exemplary signal diagram for at least some of the disclosed embodiments. A sensor unit transmits a sensor reading 410 to an elevator control unit. Based on the sensor reading, the control unit determines that a particular emergency situation is present in the elevator car and that the car should be sent to a corresponding floor for responding to the emergency. Accordingly, the elevator control unit sends a command 420 to an elevator component (in this case, possibly an elevator drive component) to move the car to the corresponding floor. The elevator control unit also sends a notification 430 to an alarm monitor. Later, the elevator control unit sends guidance information 440 to the sensor unit to aid the passenger once the car arrives at the corresponding floor.

The following non-limiting example shows how embodiments of one or more technologies disclosed herein can be used. In this case, the example is described with reference to the elevator system 110 and the building 100 of FIG. 1. While a passenger is in an elevator car 130, the portable sensor unit 172 records body measurements that suggest the passenger is experiencing a heart attack. The sensor unit 172 wirelessly transmits these body measurements and a corresponding diagnosis ("possible heart attack") to the elevator control 150. The elevator control 150 receives the body measurements and diagnosis. Based on its programming, the elevator control 150 determines that the most appropriate floor (out of several possible floors) for a heart attack victim is floor 126. Floor 126 contains an emergency device 196, namely, a medical device for treating heart attacks, and an emergency medical technician (EMT) 186. The elevator control 150 notifies the corresponding EMT 186 and causes the installation 110 to move the car 130 to floor 126. Before reaching floor 126, the EMT 186 is alerted to the arrival of the car 130, and the doors of the car 130 are held open, allowing the EMT 186 to aid the passenger. The alarm monitor 176 notifies an ambulance service that an emergency is occurring in the building 100. Possibly, the EMT 186 moves the car 130 to another floor. For example, the car 130 can be moved to the ground floor or another floor that eases removal of the victim from the building 100. Or, the installation 110 can inform the EMT 186 of an impending trip with the car 130 to a floor where an ambulance is arriving.

In another non-limiting example (also described with reference to the elevator system 110 and the building 100 of FIG. 1), a passenger riding in an elevator car 130 is the victim of a crime. In this particular example, the passenger is attacked by another person in the car 130. The sensor unit 174 transmits to the elevator control 150 measurements that can be signs of violent activity in the car 130 (e.g., sounds similar to screaming, signs that the passenger is moving suddenly). As a result of receiving these measurements, the control unit 150 determines that the car should be sent to floor 122, since a security guard 182 is stationed on that floor. The control unit 150 alerts the security guard of the possible criminal activity and causes the installation 110 to move the car 130 to floor 122. Upon reaching floor 122, the security guard is alerted to the arrival of the car 130, and the doors of the car 130 are held open, allowing the guard 182 to aid the passenger. The alarm monitor 176 notifies a security service or law enforcement agency that an emergency is occurring in the building 100.

As seen at least in the examples of the immediately preceding two paragraphs, at least some embodiments of the disclosed technologies can provide improved medical and/or safety support for elevator users. The victim of a medical emergency or crime can be transported to a floor where assistance is available. Different types of assistance can be provided in advance at different floors. This could be valuable in, for example, a building occupied by elderly or medically infirm people (e.g., a retirement community). The victim would also avoid being trapped in the elevator during the emergency.

Figure 5:
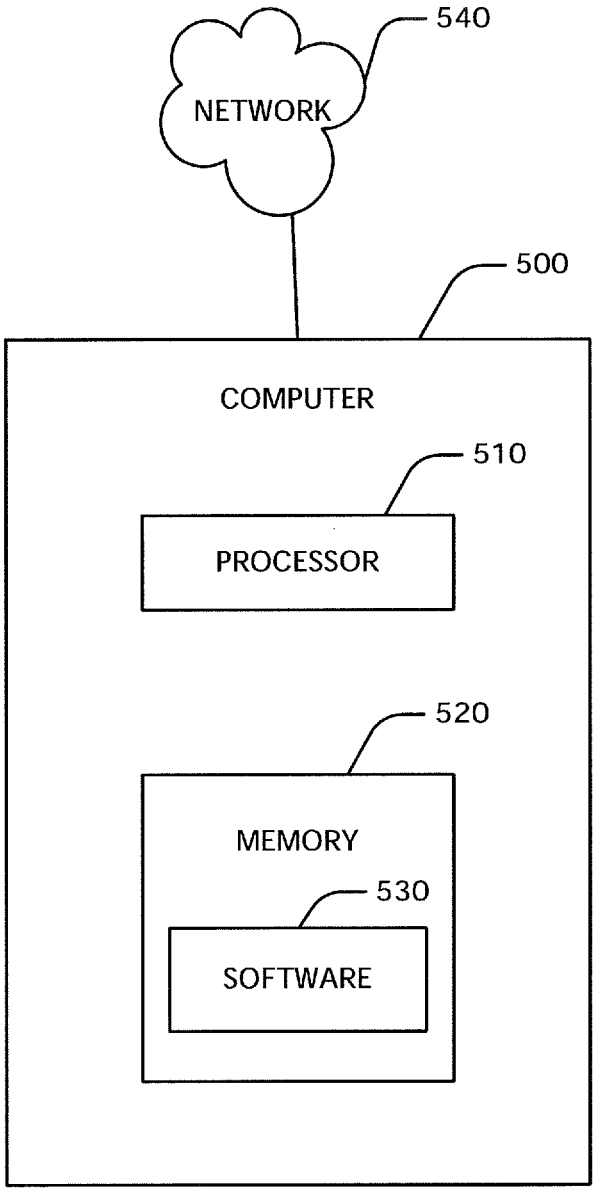
FIG. 5 is a block diagram of an exemplary embodiment of a computer.

FIG. 5 shows a block diagram of an exemplary embodiment of a computer 500 (e.g., part of an elevator control, part of an alarm monitor, part of a sensor unit) that can be used with one or more technologies disclosed herein. The computer 500 comprises one or more processors 510. The processor 510 is coupled to a memory 520, which comprises one or more computer-readable storage media storing software instructions 530. When executed by the processor 510, the software instructions 530 cause the processor 510 to perform one or more method acts disclosed herein. The computer 500 can communicatively couple to a network 540 to exchange information with other electronic devices. Further embodiments of the computer 500 can comprise one or more additional components.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope of these claims.

I claim:

1. An elevator operation method, comprising:

receiving, using a computer, an indication of an emergency situation for a passenger in an elevator car, the indication of the emergency situation being received from a sensor unit borne by the passenger;

based on the indication and using the computer, selecting an emergency type for the emergency situation out of a plurality of possible emergency types; and moving the elevator car to a building floor associated with the selected emergency type.

2. The elevator operation method of claim 1, the sensor unit storing patient data for the passenger.

3. The elevator operation method of claim 1, the indication of the emergency situation being received from a sensor unit attached to the elevator car.

4. The elevator operation method of claim 1, the indication of the emergency situation being received from a button in the elevator car.

5. The elevator operation method of claim 1, the plurality of possible emergency types comprising a first emergency type and a second emergency type, the first emergency type being associated with a first floor and the second emergency type being associated with a second floor, the first floor being different from the second floor.

6. The elevator operation method of claim 1, further comprising holding one or more doors of the elevator car at least partially open after the elevator car reaches the floor associated with the selected emergency type.

7. The elevator operation method of claim 1, the floor associated with the selected emergency type having one or more emergency devices for the selected emergency type.

8. The elevator operation method of claim 1, the floor associated with the selected emergency type having one or more persons for handling the selected emergency type.

9. The elevator operation method of claim 1, the selected emergency type being a lost-passenger emergency type.

10. The elevator operation method of claim 1, further comprising notifying medical personnel of arrival of the elevator car at the building floor associated with the selected emergency type.

11. An elevator installation, comprising:

an elevator car disposed in an elevator shaft; and a computer-based elevator control unit, the elevator control unit being configured to:

receive an indication of an emergency situation for a passenger in the elevator car, the indication of the emergency situation being received from a sensor unit borne by the passenger;

based on the indication, select an, emergency type for the emergency situation out of a plurality of possible emergency types; and move the elevator car to a building floor associated with the selected emergency type.

12. The elevator installation of claim 11, the plurality of possible emergency types comprising a first medical emergency type and a second medical emergency type, the first medical emergency type being associated with a first building floor and the second medical emergency type being associated with a second building floor, the first building floor being different from the second building floor.

13. The elevator installation of claim 11, the plurality of possible emergency types comprising a medical emergency type and a crime emergency type.

14. One or more computer-readable storage media having encoded thereon instructions that, when executed by a processor, cause the processor to perform a method, the method comprising:

receiving an indication of an emergency situation for a passenger in an elevator car, the indication of the emergency situation being received from a sensor unit borne by the passenger;

based on the indication, selecting an emergency type for the emergency situation out of a plurality of possible emergency types; and moving the elevator car to a building floor associated with the selected emergency type.

15. One or more computer-readable storage media having encoded thereon instructions that, when executed by a processor, cause the processor to perform a method, the method comprising:

receiving biometric data for a person from a sensor unit borne by the passenger;

determining, based on the biometric data, that the person is in an emergency situation; and sending an indication of the emergency situation to an elevator installation.

16. The one or more computer-readable storage media of claim 15, the person being inside an elevator car of the elevator installation when the indication of the emergency situation is sent.

17. The one or more computer-readable storage media of claim 15, the person being outside of an elevator car of the elevator installation when the indication of the emergency situation is sent.

18. An elevator control unit comprising:

a processor; and one or more computer-readable storage media having encoded thereon instructions that, when executed by the processor, cause the processor to perform a method, the method comprising:

receiving an indication of an emergency situation for a passenger in an elevator car, the indication of the emergency situation being received from a sensor unit borne by the passenger;

based on the indication, selecting an emergency type for the emergency situation out of a plurality of possible emergency types; and moving the elevator car to a building floor associated with the selected emergency type.

19. The elevator operation method of claim 1, further comprising transmitting an emergency situation signal to an alarm-monitoring system based on the indication of the emergency situation for the alarm-monitoring system to perform at least one action responsive thereto.

* * * * *